US012344913B2

(12) United States Patent
Sakurada et al.

(10) Patent No.: US 12,344,913 B2
(45) Date of Patent: Jul. 1, 2025

(54) HOT-ROLLED STEEL SHEET AND MANUFACTURING METHOD THEREOF

(71) Applicant: NIPPON STEEL CORPORATION, Tokyo (JP)

(72) Inventors: Eisaku Sakurada, Tokyo (JP); Takashi Yasutomi, Tokyo (JP); Genki Abukawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 529 days.

(21) Appl. No.: 17/794,672

(22) PCT Filed: Apr. 21, 2021

(86) PCT No.: PCT/JP2021/016148
§ 371 (c)(1),
(2) Date: Jul. 22, 2022

(87) PCT Pub. No.: WO2021/225074
PCT Pub. Date: Nov. 11, 2021

(65) Prior Publication Data

US 2023/0097055 A1 Mar. 30, 2023

(30) Foreign Application Priority Data

May 8, 2020 (JP) ..... 2020-082656

(51) Int. Cl.
*C21D 9/46* (2006.01)
*C21D 8/02* (2006.01)
(Continued)

(52) U.S. Cl.
CPC ..... *C21D 9/46* (2013.01); *C21D 8/0226* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C22C 38/34* (2013.01); *C22C 38/38* (2013.01);
(Continued)

(58) Field of Classification Search
None
See application file for complete search history.

(56) References Cited

U.S. PATENT DOCUMENTS

2013/0167985 A1 7/2013 Saito et al.
2015/0376730 A1 12/2015 Shuto et al.
(Continued)

FOREIGN PATENT DOCUMENTS

EP 3 000 905 A1 3/2016
JP 3858146 B2 12/2006
(Continued)

*Primary Examiner* — Jenny R Wu
(74) *Attorney, Agent, or Firm* — Birch, Stewart, Kolasch & Birch, LLP

(57) ABSTRACT

Adopted are a hot-rolled steel sheet having a predetermined chemical composition, in which a region, where a rotation angle between a normal line of a surface and a (011) pole near the normal line becomes 5° or less, is 0.150 or less from the surface in terms of a sheet thickness direction position standardized by a sheet thickness, and a region, where the rotation angle becomes 20° or more, is 0.250 or more from the surface in terms of the sheet thickness direction position standardized by the sheet thickness and a manufacturing method thereof.

6 Claims, 3 Drawing Sheets

(51) Int. Cl.

| | |
|---|---|
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/34*** | (2006.01) |
| ***C22C 38/38*** | (2006.01) |

(52) U.S. Cl.

CPC ..... *C21D 2211/001* (2013.01); *C21D 2211/002* (2013.01); *C21D 2211/003* (2013.01); *C21D 2211/005* (2013.01); *C21D 2211/008* (2013.01)

(56) References Cited

U.S. PATENT DOCUMENTS

| | | | | |
|---|---|---|---|---|
| 2020/0063227 | A1* | 2/2020 | Yamazaki | C22C 38/14 |
| 2020/0224294 | A1 | 7/2020 | Hirashima et al. | |
| 2021/0095363 | A1 | 4/2021 | Yokoi et al. | |

FOREIGN PATENT DOCUMENTS

| | | | |
|---|---|---|---|
| JP | 2012/62558 | A1 | 3/2012 |
| JP | 5068688 | B2 | 11/2012 |
| JP | 2016-50335 | A | 4/2016 |
| KR | 10-2011-0046654 | A | 5/2011 |
| WO | WO 2014/188966 | A1 | 11/2014 |
| WO | WO 2018/179389 | A1 | 10/2018 |
| WO | WO 2019/031583 | A1 | 2/2019 |

* cited by examiner

FIG. 1

□: EXAMPLE WHERE AVERAGE GRAIN DIAMETER OF PRIOR AUSTENITE GRAINS BECOMES 30.00μm OR MORE
○: EXAMPLE WHERE REGION WHERE ROTATIION ANGLE BETWEEN NORMAL LINE OF SURFACE AND (011) POLE NEAR NORMAL LINE BECOMES 20° OR MORE IS LESS THAN 0.250 FROM SURFACE IN TERMS OF SHEET THICKNESS DIRECTION POSITION STANDARDIZED BY SHEET THICKNESS
◆: EXAMPLE WHERE AVERAGE GRAIN DIAMETER OF PRIOR AUSTENITE GRAINS BECOMES LESS THAN 30.00μm AND REGION WHERE ROTATION ANGLE BETWEEN NORMAL LINE OF SURFACE AND (011) POLE NEAR NORMAL LINE BECOMES 20° OR MORE IS 0.250 OR MORE FROM SURFACE IN TERMS OF SHEET THICKNESS DIRECTION POSITION STANDARDIZED BY SHEET THICKNESS

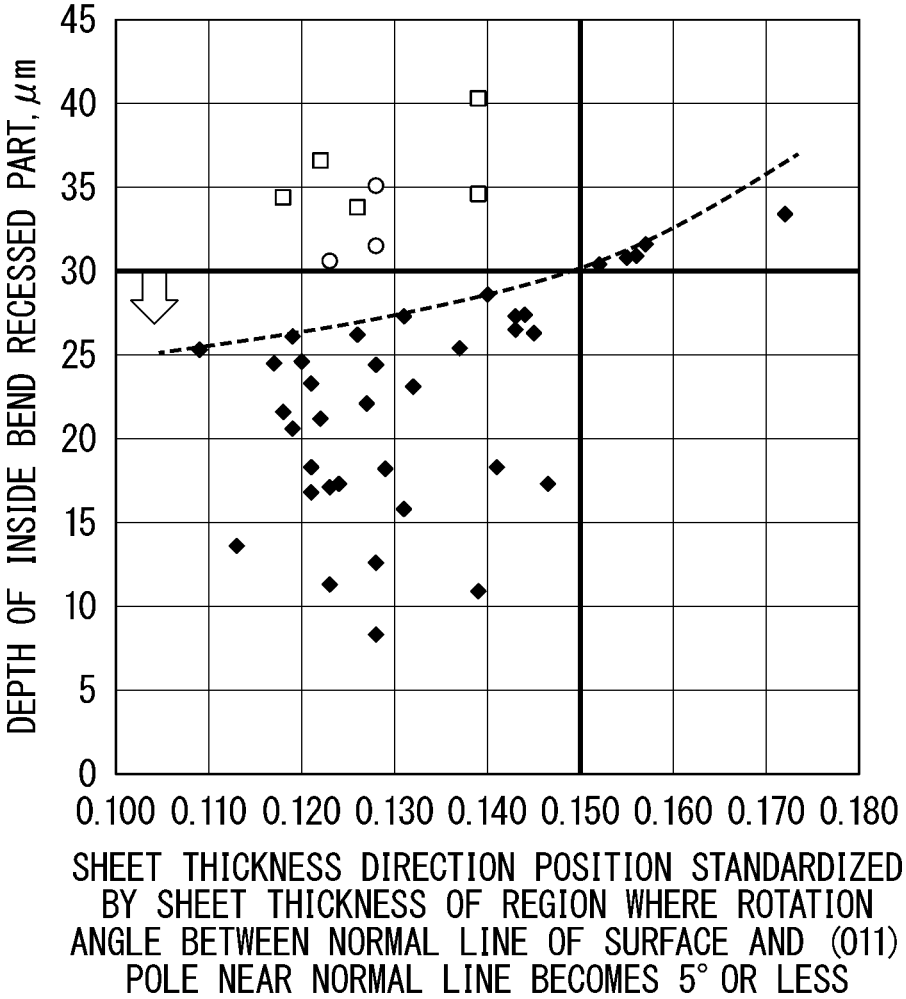

HOT-ROLLED STEEL SHEET AND MANUFACTURING METHOD THEREOF

TECHNICAL FIELD OF THE INVENTION

The present invention relates to a hot-rolled steel sheet and a manufacturing method thereof.

Priority is claimed on Japanese Patent Application No. 2020-082656, filed May 8, 2020, the content of which is incorporated herein by reference.

BACKGROUND ART

In recent years, weight reduction of automobiles and each machine component has been underway. Designing an optimum shape as the component shape ensures stiffness and thereby makes it possible to reduce the weights of automobiles and each machine component. Furthermore, in blank-formed components such as a press-formed component, the weights can be reduced by reducing the sheet thicknesses of component materials. However, in the case of attempting to ensure the static fracture strength and the yield strength while reducing the sheet thicknesses, it becomes necessary to use high-strength materials. In particular, for automobile suspension components such as lower control arms, trailing arms, or knuckles, studies have begun about the application of higher than 780 MPa class steel sheets. Since these automobile suspension components are manufactured by performing bending forming and the like on steel sheets, steel sheets that are applied to these automobile suspension components are required to have excellent formability.

For example, Patent Document 1 discloses a hot-rolled steel sheet in which, in a hot rolling step, the finish rolling temperature and the rolling reduction are set within predetermined ranges, thereby controlling the grain sizes and aspect ratios of prior austenite and reducing anisotropy.

Patent Document 2 discloses a cold-rolled steel sheet in which, in a hot rolling step, the rolling reduction and the average strain rate are set within appropriate ranges in a predetermined finish rolling temperature range, thereby improving the toughness.

In order to further reduce the weights of automobiles, each machine component, or the like, it is also expected to apply steel sheets having a sheet thickness premised on a cold-rolled steel sheet to automobile suspension components. The techniques described in Patent Document 1 and Patent Document 2 are effective in the manufacturing of automobile suspension components to which a high strength steel sheet is applied.

However, the present inventors found that, even in steel sheets to which the techniques of Patent Document 1 and Patent Document 2 are applied, there are cases where the fatigue properties (durability and impact resistance) after the steel sheets are formed into component shapes are not sufficient. This is considered to be because a sharpened recessed part such as a fine crack is formed in the cross section of the inside of a bend (hereinafter, simply referred to as "inside bend") in a bending forming part even when a load simulating the operation environment is not imparted after bending forming. It is considered that this recessed part brings about an effect of a notch such as a fine crack and degrades the durability of components. The inventors found that the formation of a sharpened recessed part such as a fine crack at the inside bend becomes easier as the strength of a steel sheet increases.

PRIOR ART DOCUMENT

Patent Document

[Patent Document 1] Japanese Patent No. 5068688
[Patent Document 2] Japanese Patent No. 3858146

DISCLOSURE OF THE INVENTION

Problems to be Solved by the Invention

The inventors investigated recessed parts that are formed at the inside bend in order to enable the provision of a steel sheet that is a high strength steel sheet and has improved in terms of a sharpened recessed part at an inside bend that is initiated during bending forming. As a result, the present inventors found that the sharpened recessed part such as a fine crack at the inside bend (hereinafter, a sharpened recessed part such as a fine crack that is formed at a inside bend will be referred to as "inside bend recessed part") is not a fine crack and is attributed to unevenness formed by the plastic buckling of the surface layer of the steel sheet toward the outside of the plane in a microscopic region during bending forming. In addition, the present inventors found that, in a case where the depth of an inside bend recessed part exceed a certain value, the fatigue properties of hot-rolled steel sheets significantly deteriorate.

An object of the present invention is to provide a hot-rolled steel sheet having a high strength and excellent formability and enabling reduction in the depth of an inside bend recessed part that is formed during bending forming and a manufacturing method thereof.

Means for Solving the Problem

As a result of inventive studies, the present inventors found that the depth of an inside bend recessed part formed during bending forming can be reduced to an extent that component performance is not degraded by setting a chemical composition and a metallographic structure appropriate for obtaining a high strength and, furthermore, particularly controlling the rotation angle of a specific crystal orientation in the sheet thickness direction. A high strength in the present embodiment means that the tensile (maximum) strength is 880 MPa or more. In addition, excellent formability means that the hole expansion rate is 35% or more.

The gist of the present invention made based on the above-described findings is as follows.

(1) A hot-rolled steel sheet according to an aspect of the present invention contains, as a chemical composition, by mass %:

C: 0.060% to 0.170%,
Si: 0.030% to 1.700%,
Mn: 1.20% to 3.00%,
Al: 0.010% to 0.700%,
Nb: 0.005% to 0.050%,
P: 0.0800% or less,
S: 0.0100% or less,
N: 0.0050% or less,
Ti: 0% to 0.1800%,
Mo: 0% to 0.150%,
V: 0% to 0.3000%,
Cr: 0% to 0.500%,
B: 0% to 0.0030%, and
a remainder consisting of Fe and an impurity, in which, in metallographic structures at a ¼ position in a sheet thickness direction from a surface and at a ½ position in the sheet thickness direction from the surface, by vol %, bainite and martensite are a total of 80.0% or more, ferrite is 20.0% or less, and cementite and residual austenite are a total of 0% to 10.0%, in a metallographic structure of a region from the surface to a 100 μm position in the sheet thickness direction from the surface, an average grain diameter of prior austenite grains is less than 30.00 μm, a region, where a rotation angle between a normal line of the surface and a (011) pole near the normal line is 5° or less, is 0.150 or less from the surface in terms of a sheet thickness direction position standardized by a sheet thickness, a region, where the rotation angle between the normal line of the surface and the (011) pole near the normal line becomes 20° or more, is 0.250 or more from the surface in terms of the sheet thickness direction position standardized by the sheet thickness, and a tensile strength is 880 MPa or more.

(2) The hot-rolled steel sheet according to (1) may further contain, as the chemical composition, by mass %, one or more selected from the group consisting of Ti: 0.0200% to 0.1800%, Mo: 0.030% to 0.150%, V: 0.0500% to 0.3000%, Cr: 0.050% to 0.500%, and B: 0.0001% to 0.0030%.

(3) A manufacturing method of a hot-rolled steel sheet according to another aspect of the present invention is a manufacturing method of the hot-rolled steel sheet according to (1) or (2), including a casting step of, in continuous casting of a slab having the chemical composition according to (1), performing the continuous casting in a manner that an average surface temperature gradient in a region from a meniscus to 1.0 m from the meniscus becomes 300 to 650° C./m to obtain the slab, a heating step of heating the slab to 1200° C. or higher and holding the slab for 30 minutes or longer, a hot rolling step of performing rough rolling on the slab, and performing finish rolling in a manner that a total rolling reduction in a temperature range of 870° C. to 980° C. becomes 80% or larger, an elapsed time between rolling stands in the temperature range of 870° C. to 980° C. becomes 0.3 to 5.0 seconds, and a total rolling reduction in a temperature range of lower than 870° C. becomes smaller than 10%, a cooling step of cooling for 30.0 seconds or shorter to cool to a temperature range of lower than 300° C. after the finish rolling, and a coiling step of coiling in a manner that a coiling temperature becomes lower than 300° C. after the cooling.

(4) The manufacturing method of the hot-rolled steel sheet according to (3) may further include a heat treatment step of holding in a temperature range of 200° C. or higher and lower than 450° C. for 90 to 80000 seconds after the coiling.

Effects of the Invention

According to the aspects of the present invention, it is possible to provide a hot-rolled steel sheet having a high strength and excellent formability and enabling reduction in the depth of an inside bend recessed part that is formed during bending forming and a manufacturing method thereof.

BRIEF DESCRIPTION OF THE DRAWINGS

FIG. 1 is a view showing a relationship between a sheet thickness direction position standardized by a sheet thickness of a region where a rotation angle between a normal line of a surface of a steel sheet and a (011) pole near the normal line becomes 5° or less and a depth of an inside bend recessed part in an example.

EMBODIMENTS OF THE INVENTION

Figure 2:
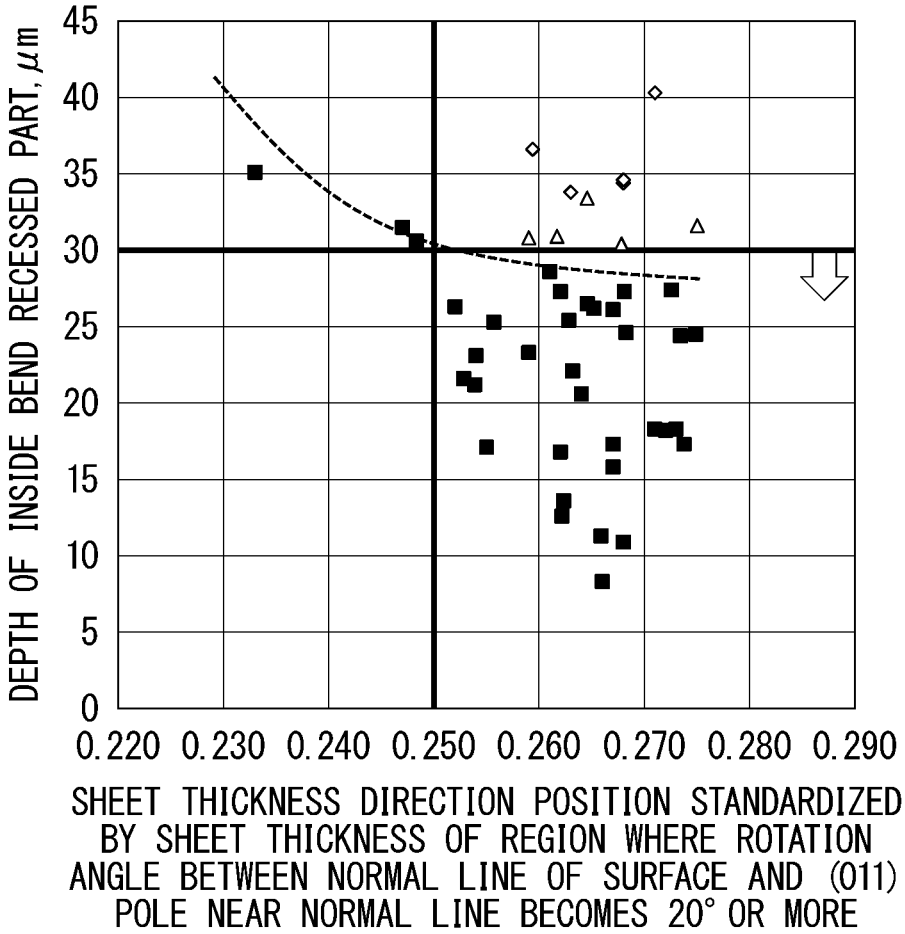
FIG. 2 is a view showing a relationship between a sheet thickness direction position standardized by the sheet thickness of a region where the rotation angle between the normal line of the surface of the steel sheet and the (011) pole near the normal line becomes 20° or more and the depth of the inside bend recessed part in the example.

Hereinafter, a hot-rolled steel sheet according to the present embodiment (hereinafter, simply referred to as the steel sheet in some cases) will be described in detail. However, the present invention is not limited only to a configuration disclosed in the present embodiment and can be modified in a variety of manners within the scope of the gist of the present invention.

Numerical limiting ranges expressed below using "to" include the lower limit and the upper limit in the ranges. Numerical values expressed with "more than" and "less than" are not included in numerical ranges. "%" regarding chemical compositions all indicates "mass %".

The hot-rolled steel sheet according to the present embodiment contains, by mass %, C: 0.060% to 0.170%, Si: 0.030% to 1.700%, Mn: 1.20% to 3.00%, Al: 0.010% to 0.700%, Nb: 0.005% to 0.050%, P: 0.0800% or less, S: 0.0100% or less, N: 0.0050% or less, and a remainder of Fe and an impurity. Hereinafter, each element will be described in detail.

C: 0.060% to 0.170%

C is one element that determines the strength of the hot-rolled steel sheet. When the C content is less than 0.060%, it is not possible to obtain a tensile strength of 880 MPa or more. Therefore, the C content is set to 0.060% or more. The C content is preferably 0.080% or more.

On the other hand, when the C content is more than 0.170%, the hole expansibility of the hot-rolled steel sheet deteriorates, and it is not possible to obtain a hole expansion rate of 35% or more. Hot-rolled steel sheets having a hole expansion rate of less than 35% are not applicable to components. Therefore, the C content is set to 0.170% or less. The C content is preferably 0.150% or less.

Si: 0.030% to 1.700%

Si is an element that improves the strength of the hot-rolled steel sheet by solid solution strengthening. In addition, Si is also an element that has an effect on suppressing the formation of a carbide and suppresses softening during a heat treatment. In order to obtain these effects, the Si content is set to 0.030% or more. The Si content is preferably 0.050% or more.

On the other hand, since Si has a high oxide-forming capability, when the Si content is excessive, an oxide is formed in a weld or the volume percentage of residual austenite becomes more than 10%, and the hole expansibility of the hot-rolled steel sheet deteriorates. Therefore, the Si content is set to 1.700% or less. In order to further suppress softening during tempering, the Si content is preferably set to 1.300% or less.

Mn: 1.20% to 3.00%

Mn is an element necessary to improve the strength of the hot-rolled steel sheet. When the Mn content is less than 1.20%, it is not possible to obtain a tensile strength of 880 MPa or more. Therefore, the Mn content is set to 1.20% or more. The Mn content is preferably 1.50% or more.

On the other hand, when the Mn content exceeds 3.00%, the toughness of a cast slab deteriorates, and hot rolling is not possible. Therefore, the Mn content is set to 3.00% or less. The Mn content is preferably 2.70% or less.

Al: 0.010% to 0.700%

Al is an element that acts as a deoxidizing agent and improves the cleanliness of steel. In order to obtain this effect, the Al content is set to 0.010% or more. The Al content is preferably 0.100% or more.

On the other hand, when the Al content is more than 0.700%, casting becomes difficult. Therefore, the Al content is set to 0.700% or less. Al is an oxidizing element, and the Al content is preferably 0.300% or less in order to obtain an effect on additional improvement in continuous castability and a cost reduction effect.

Nb: 0.005% to 0.050%

In order to obtain an average grain diameter of prior austenite grains of less than 30.00 μm in a hot rolling step, the Nb content needs to be set to 0.005% or more. When the Nb content is less than 0.005%, it is not possible to obtain an average grain diameter of the prior austenite grains of less than 30.00 μm in the hot rolling step, and a desired metallographic structure cannot be obtained in the end. Therefore, the Nb content is set to 0.005% or more. The Nb content is preferably 0.010% or more or 0.020% or more.

On the other hand, when the Nb content is more than 0.050%, the toughness of the cast slab deteriorates, and hot rolling is not possible. Therefore, the Nb content is set to 0.050% or less. The Nb content is preferably 0.040% or less.

P: 0.0800% or Less

P is an impurity element that is inevitably incorporated into the hot-rolled steel sheet in a manufacturing process of the hot-rolled steel sheet. The higher the P content, the more the hot-rolled steel sheet embrittles. In a case where the hot-rolled steel sheet is applied to automobile suspension components, a P content of up to 0.0800% is acceptable. Therefore, the P content is set to 0.0800% or less. The P content is preferably 0.0500% or less. When the P content is reduced to less than 0.0005%, the dephosphorization cost significantly increases, and thus the P content may be set to 0.0005% or more.

S: 0.0100% or Less

In a case when a large amount of S is contained in molten steel, MnS is formed, and the hole expansibility and toughness of the hot-rolled steel sheet are degraded. Therefore, the S content is set to 0.0100% or less. The S content is preferably 0.0080% or less. When the S content is reduced to less than 0.0001%, the desulfurization cost significantly increases, and thus the S content may be set to 0.0001% or more.

N: 0.0050% or Less

N is an impurity element that is inevitably incorporated into the hot-rolled steel sheet in the manufacturing process of the hot-rolled steel sheet. When the N content becomes more than 0.0050%, the amount of residual austenite in the hot-rolled steel sheet increases, and there are cases where the hole expansibility of the hot-rolled steel sheet deteriorates and the slab toughness deteriorates. Therefore, the N content is set to 0.0050% or less. The N content is preferably 0.0040% or less. When the N content is reduced to less than 0.0001%, the steelmaking cost significantly increases, and thus the N content may be set to 0.0001% or more.

The remainder of the chemical composition of the hot-rolled steel sheet according to the present embodiment may be Fe and an impurity. In the present embodiment, the impurity means a substance that is incorporated from ore as a raw material, a scrap, a manufacturing environment, or the like and is allowed to an extent that the hot-rolled steel sheet according to the present embodiment is not adversely affected.

The hot-rolled steel sheet according to the present embodiment may contain one or more of the group consisting of Ti, Mo, V, Cr, and B as an arbitrary element instead of some of Fe. In a case where the arbitrary element is not contained, the lower limit of the content is 0%. Hereinafter, each arbitrary element will be described.

Ti: 0% to 0.1800%,

Ti is an element that increases the strength of the hot-rolled steel sheet by being precipitated as a fine carbide in steel and thus may be contained. In order to reliably obtain the effect, the Ti content is preferably set to 0.0200% or more. On the other hand, even when more than 0.1800% of Ti is contained, the above-described effect is saturated. Therefore, the Ti content is preferably set to 0.1800% or less.

Mo: 0% to 0.150%

Mo is an element that enhances the hardenability of steel and may be contained as an element that adjusts the strength of the hot-rolled steel sheet. In order to reliably obtain the above-described effect, the Mo content is preferably set to 0.030% or more. On the other hand, even when more than 0.150% of Mo is contained, the above-described effect is saturated. Therefore, the Mo content is preferably set to 0.150% or less.

V: 0% to 0.3000%

V is an element that develops an effect similar to that of Ti. In order to reliably obtain an effect of precipitation hardening by the formation of a fine carbide, the V content is preferably set to 0.0500% or more. However, when V is excessively contained, a nitride is formed in steel, which degrades the slab toughness and makes threading difficult. Therefore, the V content is preferably set to 0.3000% or less.

Cr: 0% to 0.500%

Cr is an element that develops an effect similar to that of Mn. In order to reliably obtain a strength improvement effect of the hot-rolled steel sheet, the Cr content is preferably set to 0.050% or more. On the other hand, even when more than 0.500% of Cr is contained, the above-described effect is saturated. Therefore, the Cr content is preferably set to 0.500% or less.

B: 0% to 0.0030%

B is an element that develops an effect similar to that of Mo and is an element that has an effect on improvement in hardenability and increases the strength of the hot-rolled steel sheet. In order to reliably obtain the effect, the B content is preferably set to 0.0001% or more. On the other hand, even when more than 0.0030% of B is contained, the above-described effect is saturated, and thus the B content is preferably set to 0.0030% or less.

The above-described chemical composition of the hot-rolled steel sheet may be analyzed using a spark discharge emission spectrophotometer or the like. For C and S, values identified by combusting the hot-rolled steel sheet in an oxygen stream using a gas component analyzer or the like and measuring C and S by an infrared absorption method are adopted. In addition, for N, a value identified by melting a test piece collected from the hot-rolled steel sheet in a helium stream and measuring N by a thermal conductivity method is adopted.

Next, the metallographic structure of the hot-rolled steel sheet according to the present embodiment will be described. The characteristics of the metallographic structure are limited to an extent that not only an effect on improvement in the strength and formability of the hot-rolled steel sheet but also an effect on reduction in the depths of inside bend recessed parts can be obtained.

In the hot-rolled steel sheet according to the present embodiment, in the metallographic structures at a ¼ position in the sheet thickness direction from the surface and at a ½ position in the sheet thickness direction from the surface, by vol %, bainite and martensite are a total of 80.0% or more, ferrite is 20.0% or less, cementite and residual austenite are a total of 0% to 10.0%, in the metallographic structure in a region from the surface to a 100 μm position in the sheet thickness direction from the surface, the average grain diameter of prior austenite grains is less than 30.00 μm, a region, where the rotation angle between the normal line of the surface and a (011) pole near the normal line becomes 5° or less, is 0.150 or less from the surface in terms of the sheet thickness direction position standardized by the sheet thickness, a region, where the rotation angle between the normal line of the surface and the (011) pole near the normal line becomes 20° or more, is 0.250 or more from the surface in terms of the sheet thickness direction position standardized by the sheet thickness.

Hereinafter, each regulation will be described.

Bainite and martensite: Total of 80.0% or more

In a case where the volume percentage of bainite and martensite is less than 80% in total, it is not possible to obtain a tensile strength of 880 MPa or more and/or a hole expansion rate of 35% or more. Therefore, the volume percentage of the bainite and the martensite is set to a total of 80.0% or more. The volume percentage of the bainite and the martensite is preferably 83.0% or more.

The martensite may be tempered, and the martensite may contain cementite and residual austenite. The volume percentage of the cementite and the residual austenite may be set to a total of 10.0% or less.

Ferrite: 20.0% or Less

When the volume percentage of ferrite is more than 20.0%, the volume percentage of the bainite and the martensite does not become a total of 80.0% or more, and it is not possible to obtain a desired tensile strength. Therefore, the volume percentage of the ferrite is set to 20.0% or less. In order to further improve the strength, the volume percentage of the ferrite is preferably 17.0% or less and more preferably 15.0% or less. The volume percentage of the ferrite may be set to 10.0% or more from the viewpoint of ensuring hole expansibility.

Cementite and Residual Austenite: 0% to 10.0%

As described above, there are cases where martensite contain cementite and residual austenite. When the volume percentage of the cementite and the residual austenite is more than a total of 10.0%, the hole expansibility of the hot-rolled steel sheet deteriorates due to the deterioration of local deformability. Therefore, the volume percentage of the cementite and the residual austenite is set to 10.0% or less. The volume percentage of the cementite and the residual austenite is preferably 7.0% or less and more preferably 5.0% or less. The volume percentage of the cementite and the residual austenite is preferably as small as possible, and thus the lower limit is 0%.

Measuring Method of Volume Percentage of Ferrite

As the volume percentage of the ferrite, the area ratio of crystal grains in which an iron-based carbide is not formed, which are obtained by observing the structure on a metallographic structure photograph, is used. A sample is collected such that a sheet thickness cross section that intersects the rolling direction of the hot-rolled steel sheet at right angles can be observed, the cross section is corroded using a nital etching solution having a concentration of 3% to 5% to make the ferrite visible, and the structure is observed using metallographic structure photographs each captured at a magnification of 500 to 1000 times at the ¼ position in the sheet thickness direction from the surface of the hot-rolled steel sheet and at the ½ position in the sheet thickness direction from the surface. For one kind of steel, the metallographic structure photographs are prepared at 3 or more visual fields in each of the ¼ position in the sheet thickness direction from the surface and the ½ position in the sheet thickness direction from the surface. The area ratio of the ferrite that is observed in each metallographic structure photograph is obtained, and the average value thereof is calculated, thereby obtaining the volume percentage of the ferrite. The iron-based carbide is recognized as black granular contrast having a circle equivalent diameter of 1 μm or less in the metallographic structure photograph and is observed in the crystal grain.

Measuring Method of Volume Percentage of Bainite and Martensite

As the total of the volume percentages of the bainite and the martensite in the present embodiment, a value obtained by subtracting the volume percentage of the ferrite and the total of the volume percentages of the cementite and the residual austenite that are measured by a method to be described below from 100.0% is used.

Measuring Method of Volume Percentage of Residual Austenite

The volume percentage of the residual austenite is measured by EBSP. Analysis by EBSP is performed using a sample collected from the same position as the sample collection position at the time of measuring the volume percentage of the ferrite at the ¼ position in the sheet thickness direction from the surface of the hot-rolled steel sheet and at the ½ position in the sheet thickness direction from the surface. The sample needs to be polished using silicon carbide paper #600 to #1500, then, finished into a mirror surface using a liquid containing a diamond powder having grain sizes of 1 to 6 μm dispersed in a diluted solution such as an alcohol or pure water, and then finished by electrolytic polishing for the purpose of sufficiently removing strain in a cross section to be measured. In the electrolytic polishing, in order to remove mechanical polishing strain on an observed section, the sample needs to be polished a minimum of 20 μm and polished a maximum of 50 μm. The sample is preferably polished 30 μm or less in consideration of rollover at the end portion.

In the measurement by EBSP, the accelerating voltage is set to 15 to 25 kV, the measurement is performed at intervals of at least 0.25 μm or less, and the crystal orientation information at each measurement point in a range that is 150 μm or more in the sheet thickness direction and 250 μm or more in a rolling direction is obtained. Out of the obtained crystal structures, grains having an fcc crystal structure are determined as the residual austenite using a "Phase Map" function installed in software "OIM Analysis (registered trademark)" included in an EBSP analyzer. The ratio of measurement points determined as the residual austenite is obtained, thereby obtaining the area ratio of the residual austenite. The obtained area ratio of the residual austenite is regarded as the volume percentage of the residual austenite.

Here, the larger the number of the measurement points, the more preferable, and thus it is preferable that the measurement intervals are narrow and the measurement range is wide. However, in a case where the measurement intervals are less than 0.01 μm, adjacent points interfere with the spreading width of an electron beam. Therefore, the measurement intervals are set to 0.01 μm or more. In addition, the measurement range needs to be set to 200 μm in the sheet thickness direction and 400 μm in the sheet width direction at a maximum. In addition, in the measurement, an instrument including a thermal field emission-type scanning electron microscope (JSM-7001F manufactured by JEOL Ltd.) and an EBSD detector (DVC 5-type detector manufactured by TSL) is used. At this time, the degree of vacuum in the instrument is set to $9.6\times10^{-5}$ Pa or less, the irradiation current level is set to 13, and the irradiation level of the electron beam is set to 62.

Measuring Method of Volume Percentage of Cementite

The volume percentage of the cementite is measured using a sample collected from the same position as the sample collection position at the time of measuring the volume percentage of the ferrite at the ¼ position in the sheet thickness direction from the surface of the hot-rolled steel sheet and at the ½ position in the sheet thickness direction from the surface. The sheet thickness cross section is polished with abrasive paper or alumina abrasive grains to be finished into a mirror surface, then, corroded with a 3% nital solution and picral, and observed using a scanning electron microscope (SEM). Subsequently, a plurality of visual fields are captured using a photograph device attached to the SEM at a magnification of 2000 times such that the total observed visual field area becomes $1.6\times10^{7}$ $\mu m^2$ or more, and the area ratio of the cementite is measured using image analysis software such as particle analysis software. Therefore, the area ratio of the cementite is obtained. The obtained area ratio of the cementite is regarded as the volume percentage of the cementite.

Average Grain Diameter of Prior Austenite Grains: Less Than 30.00 μm

The inside bend recessed part is caused by the plastic buckling of crystal grains in the surface layer of the hot-rolled steel sheet and is affected by the sizes of the structures of the bainite and the martensite, which have low deformability. For the sizes of these structures, the size of the prior austenite grain becomes the maximum unit (that is, there is no case where the bainite and the martensite become larger than the prior austenite grain). As a characteristic, the bainite and the martensite are in a form of being divided into several structural units called blocks. In order to make the depths of the inside bend recessed parts less than 30.0 μm, the average grain diameter of the prior austenite grains, which becomes the maximum size of the structural units of the bainite and the martensite, which are primary phases (volume percentage of 80.0% or more) of the hot-rolled steel sheet according to the present embodiment, is set to less than 30.00 μm. In order to further suppress the deterioration of the fatigue properties attributed to the inside bend recessed parts, the average grain diameter of the prior austenite grains is preferably set to less than 20.00 μm. In addition, since the deterioration of the fatigue properties attributed to the inside bend recessed parts is affected by the average grain diameter of the prior austenite grains in the surface layer region, it is in a surface layer region (a region from the surface of the hot-rolled steel sheet to a 100 μm position in the sheet thickness direction from the surface) that the average grain diameter of the prior austenite grains is set to less than 30.00 μm.

Measuring Method of Average Grain Diameter of Prior Austenite Grains

In order to measure the average grain diameter of the prior austenite grains, a sample is collected such that a sheet thickness cross section that intersects the rolling direction of the hot-rolled steel sheet at right angles can be observed, and the sample is used after the structure on the sheet thickness cross section is made visible with a saturated aqueous solution of picric acid and an etching solution of sodium dodecylbenzene sulfonate. In a surface layer region (a region from the surface of the hot-rolled steel sheet to a 100 μm position in the sheet thickness direction from the surface) of this sample, the circle equivalent diameters of the prior austenite grains are measured using a structure photograph captured at a magnification of 500 times using a scanning electron microscope. The scanning electron microscope needs to be equipped with a two-electron detector. Regarding the capturing of the structure photograph, the sample is irradiated with an electron beam in a vacuum at $9.6\times10^{-5}$ Pa or less, an accelerating voltage of 15 kV, and an irradiation current level of 13, and a secondary electron image of the surface layer region (the region from the surface of the hot-rolled steel sheet to the 100 μm position in the sheet thickness direction from the surface) is captured. The number of visual fields captured is set to 10 or more visual fields. In the captured secondary electron image, the prior austenite grain boundaries are captured as bright contrast. The circle equivalent diameter is calculated for one of the prior austenite grains that is included in the observed visual field. The above-described operation is performed on all of the prior austenite grains that are included in the observed visual field except for prior austenite grains that are not fully included in the captured visual field, such as prior austenite grains in the end portion of the captured visual field, and the circle equivalent diameters of all of the prior austenite grains in the captured visual field are obtained. The average grain diameter of the prior austenite grains is obtained by calculating the average value of the circle equivalent diameters of the prior austenite grains obtained in the individual captured visual fields.

Region where rotation angle between normal line of surface and (011) pole near normal line becomes 5° or less: 0.150 or less from surface in terms of sheet thickness direction position standardized by sheet thickness, and region where rotation angle between normal line of surface and (011) pole near normal line becomes 20° or more: 0.250 or more from surface in terms of sheet thickness direction position standardized by sheet thickness The present inventors found that, when a region where the rotation angle between the normal line of the surface of the hot-rolled steel sheet and the (011) pole near the normal line becomes 5° or less is made present at 0.150 or less from the surface in terms of the sheet thickness direction position standardized by the sheet thickness, and a region where the rotation angle becomes 20° or more is made present at 0.250 or more from the surface in terms of the sheet thickness direction position standardized by the sheet thickness, it is possible to reduce the depths of inside bend recessed parts in an arbitrary sheet surface direction. The sheet thickness direction position standardized by the sheet thickness is expressed as d/t where d represents the sheet thickness direction depth and t represents the sheet thickness.

As described above, inside bend recessed parts are attributed to a microscopic plastic buckling phenomenon in the surface layer of the hot-rolled steel sheet. The present inventors considered this plastic buckling phenomenon as a microscopic plastic flow and understood that the plastic buckling phenomenon results from a basic behavior that is caused by the rotation of crystal grains. In the case of bending distortion, the amount of crystal grains rotated depends on the distortion gradient from the neutral axis toward the sheet thickness surface. The present inventors considered that the distribution of orientation groups having different crystal rotation behaviors in the sheet thickness direction causes an imbalance in local distortion and promotes buckling on the surface layer of the hot-rolled steel sheet.

Therefore, the inventors paid attention to and investigated the relationship between the depths of inside bend recessed parts and crystal orientations in the sheet thickness direction. As a typical crystal orientation, a (011) pole is drawn in the sheet thickness direction and divided into a region where the rotation angle is 5° or less and the crystal orientation does not change and a region where the rotation angle is 20° or more and the crystal orientation does not change. The present inventors considered that the thickness in a range where the crystal orientation does not change causes distortion unevenness in the sheet thickness direction and investigated the relationship between the proportions of the depths in the sheet thickness direction in the individual ranges and the depths of inside bend recessed parts. As a result, as shown in FIG. 1 and FIG. 2, when the region where the rotation angle between the normal line of the surface of the hot-rolled steel sheet and the (011) pole near the normal line becomes 5° or less is present at more than 0.150 in terms of the sheet thickness direction position (sheet thickness direction depth d/sheet thickness t) standardized by the sheet thickness, the depths of inside bend recessed parts become 30.0 μm or more. In addition, it was found that, even when the region where the rotation angle between the normal line of the surface of the hot-rolled steel sheet and the (011) pole near the normal line becomes 20° or more is present at less than 0.250 in terms of the sheet thickness direction position standardized by the sheet thickness, similarly, the depths of inside bend recessed parts become 30.0 μm or more. FIG. 1 is a view obtained from an example to be described below and a view showing the relationship between the sheet thickness direction position standardized by the sheet thickness of the region where the rotation angle between the normal line of the surface of the steel sheet and the (011) pole near the normal line becomes 5° or less and the depth of the inside bend recessed part. FIG. 2 is a view obtained from an example to be described below and a view showing the relationship between the sheet thickness direction position standardized by the sheet thickness of the region where the rotation angle between the normal line of the surface and the (011) pole near the normal line becomes 20° or more and the depth of the inside bend recessed part.

Figure 3:
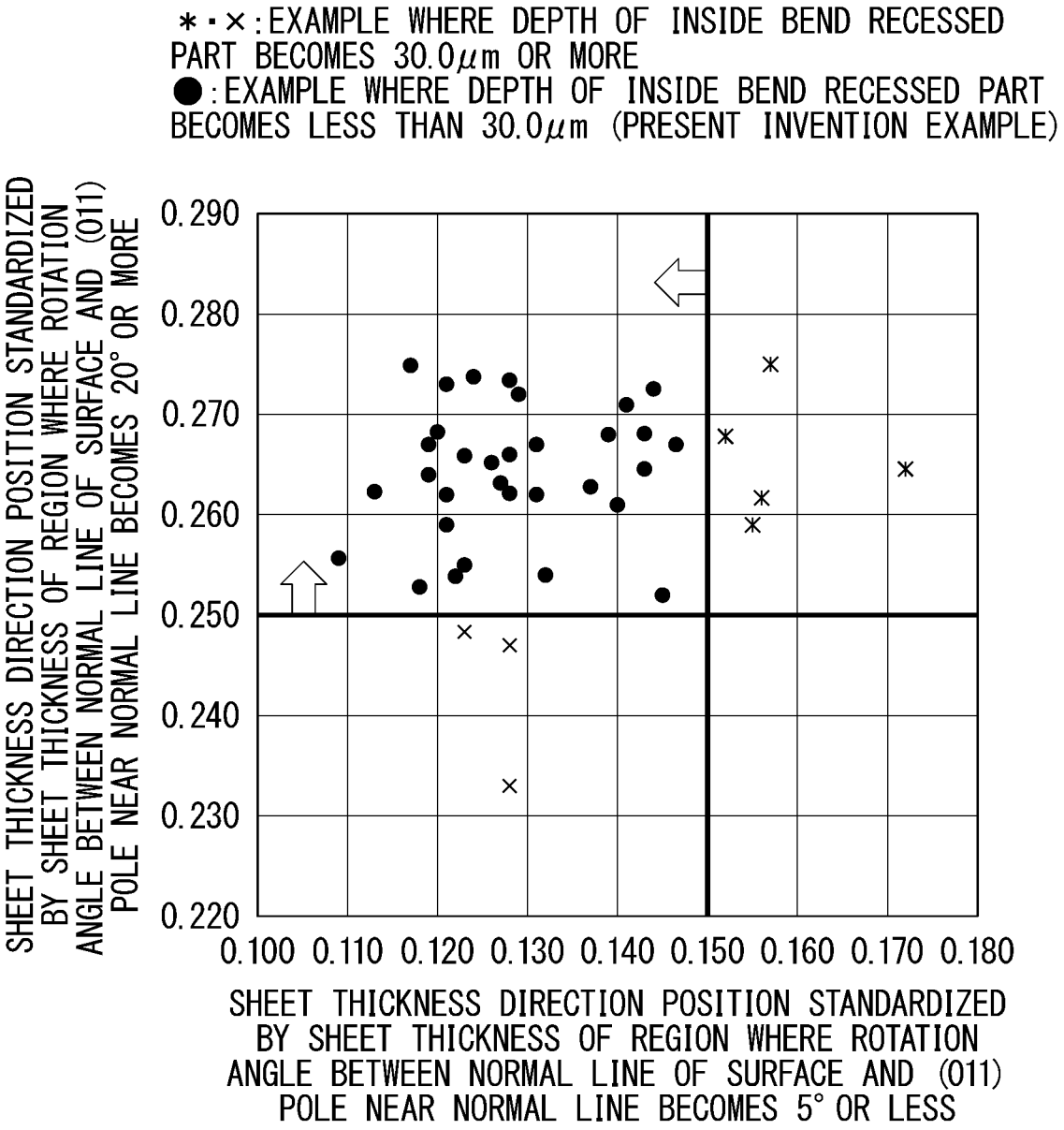
FIG. 3 is a view showing a relationship among the sheet thickness direction position standardized by the sheet thickness of the region where the rotation angle between the normal line of the surface of the steel sheet and the (011) pole near the normal line becomes 5° or less, the sheet thickness direction position standardized by the sheet thickness of the region where the rotation angle between the normal line of the surface of the steel sheet and the (011) pole near the normal line becomes 20° or more, and the evaluation result of the inside bend recessed part in the example.

From the above-described investigation, the present inventors found that, in order to reduce the depth of the inside bend recessed part, there is the most favorable range of the depth proportions of the region where the angle formed between the normal line of the surface of the hot-rolled steel sheet and the (011) pole becomes 5° or less and the region where the rotation angle becomes 20° or more. As shown in FIG. 3, when the region where the rotation angle between the normal line of the surface of the hot-rolled steel sheet and the (011) pole near the normal line becomes 5° or less is made present at 0.150 or less from the surface in terms of the sheet thickness direction position standardized by the sheet thickness, and the region where the rotation angle becomes 20° or more is made present at 0.250 or more from the surface in terms of the sheet thickness direction position standardized by the sheet thickness, it is possible to make the depths of inside bend recessed parts less than 30.0 μm. FIG. 3 is a view obtained from the example to be described below and a view showing the relationship among the sheet thickness direction position standardized by the sheet thickness of the region where the rotation angle between the normal line of the surface and the (011) pole near the normal line becomes 5° or less, the sheet thickness direction position standardized by the sheet thickness of the region where the rotation angle between the normal line of the surface and the (011) pole near the normal line becomes 20° or more, and the evaluation result of the inside bend recessed part in the example.

Hereinafter, a measuring method of the region having a predetermined rotation angle between the normal line of the surface of the steel sheet and the (011) pole near the normal line will be described.

Measurement is performed by EBSP using a sample having a cross section finished into a mirror surface by the same method as for the sample used for the measurement of the volume percentage of the prior austenite grains. The sample needs to be finished by electrolytic polishing for the purpose of sufficiently removing strain in the cross section to be measured. In the electrolytic polishing, in order to remove mechanical polishing strain on an observed section, the sample needs to be polished a minimum of 20 μm and polished a maximum of 50 μm. The sample is preferably polished 30 μm or less in consideration of rollover at the end portion.

In the measurement by EBSP, the accelerating voltage is set to 15 to 25 kV, and the measurement range is set to a measurement range that covers the overall sheet thickness. The measurement range needs to be 1000 μm or more in the rolling direction. In addition, since the purpose is to measure the average characteristics of crystal orientations, the measurement intervals may be 5 μm or more. The measurement intervals are set to 30 μm or less in order to avoid an increase in the number of crystal grains that are not measured by mistake. Crystal orientation data need to be recorded along with the measurement coordinate system. From the obtained crystal orientation data, the rotation angle between the normal line of the surface of the steel sheet and the (011) pole near the normal line is measured by the following method.

The rotation angle between the normal line of the surface of the hot-rolled steel sheet and the (011) pole near the normal line is a value that is measured by plotting the crystal orientation data obtained by the EBSP measurement on a positive pole figure. At the time of plotting the crystal orientations on the positive pole figure, in the coordinate system of the positive pole figure, poles of the (011) orientation are displayed such that normal lines (origin: ND)

become the normal lines to the sheet surface of the hot-rolled steel sheet, the horizontal axis TD becomes the sheet width direction, and the axis RD orthogonal to the horizontal axis becomes the rolling direction.

As described above, the crystal orientation is a group of points measured at predetermined intervals in a measurement range that is 1000 μm or more in the rolling direction and covers the overall sheet thickness range. This group of points is divided into 20 sections in the sheet thickness direction, and a (011) pole figure is drawn. In the (011) pole figure at each depth direction position from the surface of the steel sheet drawn as described above, the angle between the origin ND (normal line of the surface of the hot-rolled steel sheet) and the nearest (011) pole is measured. This measurement value is defined as the rotation angle between the normal line of the surface and the (011) pole near the normal line. A value obtained by dividing each depth direction position by the sheet thickness is defined as the sheet thickness direction position (sheet thickness direction depth d/sheet thickness t) standardized by the sheet thickness, and the region where the rotation angle becomes 5° or less and the region where the rotation angle becomes 20° or more are obtained at this sheet thickness direction position standardized by the sheet thickness.

Tensile Strength: 880 MPa or More

In the hot-rolled steel sheet according to the present embodiment, the tensile strength is 880 MPa or more. When the tensile strength is less than 880 MPa, it becomes difficult to apply the hot-rolled steel sheet to suspension components of automobiles. The tensile strength may be 900 MPa or more. The tensile strength is preferably as high as possible, but may be 1500 MPa or less from the viewpoint of a weight reduction effect of the high-strengthening of the hot-rolled steel sheet.

The tensile strength is measured by performing a tensile test in accordance with JIS Z 2241: 2011 using a No. 5 test piece of JIS Z 2241: 2011. A position where the tensile test piece is collected is the central position in the sheet width direction, and a direction perpendicular to the rolling direction is the longitudinal direction.

Hole Expansion Rate: 35% or More

In the hot-rolled steel sheet according to the present embodiment, the hole expansion rate is 35% or more. When the hole expansion rate is less than 35%, forming-induced fracture occurs in a burring portion, and it becomes difficult to apply the hot-rolled steel sheet to suspension components of automobiles. The hole expansion rate may be set to 50% or more in order to reduce the ironing rate of the burring portion and reduce the load on a die in a pressing step. In a case where the hole expansion rate is set to 80% or more, it is possible to eliminate ironing and to enhance the stiffness of components by obtaining a sufficient burring height. Therefore, the hole expansion rate may be set to 80% or more.

The hole expansion rate is measured by performing a hole expansion test in accordance with JIS Z 2256: 2010.

Next, a preferable manufacturing method of the hot-rolled steel sheet according to the present embodiment will be described. A casting step and a hot rolling step to be described below are important steps for controlling the crystal orientation distribution in the sheet thickness direction and the average grain diameter of the prior austenite grains, which are requirements necessary to reduce the depths of the inside bend recessed parts.

The preferable manufacturing method of the hot-rolled steel sheet according to the present embodiment includes the following steps.

A casting step of, in continuous casting of a slab having a predetermined chemical composition, performing the continuous casting in a manner that an average surface temperature gradient in a region from a meniscus to 1.0 m from the meniscus becomes 300 to 650° C./m to obtain the slab, a heating step of heating the slab to 1200° C. or higher and holding the slab for 30 minutes or longer, a hot rolling step of performing rough rolling on the slab, and then performing finish rolling in a manner that a total rolling reduction in a temperature range of 870° C. to 980° C. becomes 80% or larger, an elapsed time between rolling stands in the temperature range of 870° C. to 980° C. becomes 0.3 to 5.0 seconds, and a total rolling reduction in a temperature range of lower than 870° C. becomes smaller than 10%, a cooling step of, after the finish rolling, cooling a hot-rolled steel sheet for 30.0 seconds or shorter to cool the hot-rolled steel sheet to a temperature range of lower than 300° C., and a coiling step of, after the cooling, coiling the hot-rolled steel sheet in a manner that a coiling temperature becomes lower than 300° C.

The preferable manufacturing method of the hot-rolled steel sheet according to the present embodiment may further include a heat treatment step of, after the coiling, holding the hot-rolled steel sheet in a temperature range of 200° C. or higher and lower than 450° C. for 90 to 80000 seconds.

Hereinafter, each step will be described.

Casting Step

In the continuous casting of a slab having the above-described chemical composition, the average surface temperature gradient in a region from the meniscus to 1.0 m from the meniscus is set to 300 to 650° C./m. The surface temperature gradient in the early stage of solidification affects the rotation angle between the normal line of the surface of the hot-rolled steel sheet and the (011) pole near the normal line. In the present embodiment, the average surface temperature gradient refers to a temperature gradient obtained by dividing the temperature in a mold in contact with a solidified shell by the distance from the meniscus. The temperature is measured with thermocouples embedded in the mold. The thermocouples are embedded at a 0 mm position below the meniscus that is 0.010 mm or less from the outer surface (solidified shell) of the mold and a 1.0 mm below the meniscus that is 0.010 mm or less from the outer surface (solidified shell) of the mold in the center portion of the long side surface of the slab in the width direction. The thermocouple that is embedded at the 0 mm position below the meniscus needs to be 0.040 mm or less and preferably needs to be 0.005 mm or less distant from the meniscus (in a casting direction). A value obtained by dividing each measured temperature by the section distance is regarded as the average surface temperature gradient.

When the average surface temperature gradient in the region from the meniscus to 1.0 m from the meniscus is less than 300° C./m, the region where the rotation angle between the normal line of the surface of the hot-rolled steel sheet and the (011) pole near the normal line is 5° or less is present at more than 0.150 from the surface in terms of the sheet thickness direction position standardized by the sheet thickness. On the other hand, when the average temperature gradient in the above-described region is more than 650° C./m, the region where the rotation angle between the normal line of the surface of the hot-rolled steel sheet and the (011) pole near the normal line is 20° or more is present at less than 0.250 from the surface in terms of the sheet thickness direction position standardized by the sheet thickness. Therefore, the average surface temperature gradient in the region from the meniscus to 1.0 m from the meniscus is set to 300 to 650° C./m, and the slab is manufactured. The lower limit of the average surface temperature gradient is preferably 350° C./m or 400° C./m, and the upper limit of the average surface temperature gradient is preferably 600° C./m or 550° C./m.

The average casting velocity in the casting step may be in an ordinary range, may be 0.8 m/min or faster, or may be 1.2 m/min or faster. From the viewpoint of cost reduction, the average casting velocity in the casting step is preferably set to 1.2 m/min or faster. On the other hand, when the average casting velocity is faster than 2.5 m/min, the cooling temperature gradient in the slab thickness direction increases due to the increase in the casting velocity, and the slab internal stress in a solidification process increases, which makes it easy for a defect to be initiated. Therefore, the average casting velocity is preferably 2.5 m/min or slower. In addition, when the average casting velocity is 0.6 m/min or slower, the cooling temperature gradient in the slab thickness direction decreases, but the economic efficiency is significantly impaired. Therefore, the average casting velocity is preferably 0.6 to 2.5 m/min.

Heating Step

The slab obtained by the continuous casting is heated such that the slab surface temperature becomes 1200° C. or higher and is held in a temperature range of 1200° C. or higher for 30 minutes or longer, thereby solutionizing the slab. When the heating temperature is lower than 1200° C., homogenization and carbide dissolution by a solutionizing treatment does not proceed, and ferritic transformation proceeds, whereby the strength of the hot-rolled steel sheet decreases. In a case where the slab contains Ti, the heating temperature is preferably set to 1230° C. or higher in order to more reliably form a solid solution of Ti. In addition, regarding the slab temperature before heating, the slab may be cooled to room temperature or may remain at a high temperature after the continuous casting in a case where there is a concern of cracking caused by thermal stress or the like. The slab is heated in the heating step by charging the slab into a furnace controlled to a predetermined temperature, and a time taken for the slab surface temperature to become 1200° C. or higher needs to be set to 30 minutes or longer, which is sufficient. When the holding time in the temperature range of 1200° C. or higher is shorter than 30 minutes, it is not possible to obtain a desired amount of bainite and martensite. The holding time is preferably 40 minutes or longer, 60 minutes or longer, or 100 minutes or longer. For example, the heating temperature needs to be 1400° C. or lower, and the heating time needs to be 300 minutes or shorter.

In addition, in a case where the slab contains Ti, a time for the slab surface temperature to becomes 1230° C. or higher needs to be set to 60 minutes or longer, which is sufficient. In the furnace, the slab is disposed on an inorganic substance skid, and the slab may be solutionized by being heated to equal to or lower than a temperature at which the slab heated by a reaction between the inorganic substance and iron at this time does not dissolve.

Hot Rolling Step

After the slab is heated, rough rolling is performed, and then finish rolling is performed within a range to be described below. The finish rolling is performed such that the total rolling reduction within a temperature range of 870° C. to 980° C. becomes 80% or more. The total rolling reduction is preferably 85% or larger. In a case where the total rolling reduction within the temperature range of 870° C. to 980° C. is smaller than 80%, the average grain diameter of the austenite grains becomes 30.00 μm or more. The total rolling reduction mentioned herein is a value obtained by adding the rolling reduction at each rolling stand where the biting temperature becomes 870° C. to 980° C. When the finish rolling temperature is higher than 980° C., the average grain diameter of the austenite grains becomes large regardless of the total rolling reduction at the rolling stand, and it is not possible to control the depths of the inside bend recessed parts to less than 30.0 μm. The total rolling reduction within the temperature range of 870° C. to 980° C. may be set to 98% or less.

In addition, when the total rolling reduction at lower than 870° C. is 10% or larger, the region where the rotation angle between the normal line of the surface of the steel sheet and the (011) pole near the normal line becomes 5° or less is present at more than 0.150 from the surface in terms of the sheet thickness direction position standardized by the sheet thickness. Therefore, the total rolling reduction at lower than 870° C. is set to less than 10%. The total rolling reduction at lower than 870° C. is preferably less than 7%.

In the hot rolling step, when the total sheet reduction rate $((1-t/t_0)\times100)$, which is the ratio between a sheet thickness $t_0$ after the rough rolling and a product sheet thickness t after the finish rolling, is less than 80%, it is not possible to obtain a total rolling reduction within the temperature range of 870° C. to 980° C. of 80% or more regardless of the control of the rolling temperature. Therefore, the total sheet reduction rate is limited to 80% or more. This total sheet reduction rate is preferably as high as possible since the yield increases; however, in a case where the total sheet reduction rate exceeds 98%, the load on a rolling machine increases, and costs for roll replacement and the like increase. Therefore, the total sheet reduction rate, which is the ratio between the sheet thickness after the rough rolling and the product sheet thickness after the finish rolling, is limited to 80% or more. In addition, the total sheet reduction rate is desirably 98% or less.

The number of all rolling stands is not particularly limited and may be determined depending on the capacity, such as load capacity or torque, of the rolling machine. In a case where the number of rolling stands where the biting temperature becomes 870° C. to 980° C. is 2 stands or more and the elapsed time between the individual stands exceeds 5.0 seconds, austenite grains grow in the corresponding section, and the average grain diameter of the austenite grains becomes 30.00 μm or more, which is not preferable. Therefore, in the temperature range of 870° C. to 980° C., the elapsed time between the individual rolling stands is set to 5.0 seconds or shorter. The elapsed time is preferably 4.0 seconds or shorter. On the other hand, in a case where the time between the individual rolling stands is shorter than 0.3 seconds, the load on the rolling roll increases. Therefore, the time between the individual rolling stands is set to 0.3 seconds or longer. The elapsed time is preferably 1.0 second or longer or 2.0 seconds or longer. This biting temperature may be obtained from the surface temperature of the steel sheet measured with a thermometer such as a radiation-type thermometer installed in each rolling stand.

Cooling Step

After the finish rolling, the hot-rolled steel sheet is cooled to a temperature range of lower than 300° C. and then coiled in a manner that the coiling temperature becomes lower than 300° C. in order to obtain a tensile strength of 880 MPa or more. The coiling temperature is preferably 280° C. or lower. The coiling temperature may be set to 20° C. or higher. As the cooling after the finish rolling, the hot-rolled steel sheet is cooled in a manner that the cooling time after the finish rolling (time taken from the completion of the finish rolling to the start of coiling) becomes 30.0 seconds or shorter in order to obtain a desired amount of bainite and martensite to obtain a strength of the hot-rolled steel sheet of 880 MPa or more. The cooling time is preferably 25.0 seconds or shorter. For the cooling after the finish rolling, a cooling method such as water cooling or air cooling on a run-out table may be selected such that the cooling time becomes as desired.

As the coiling temperature, the average value of the surface temperatures of the steel sheet throughout the entire length of a coil measured throughout the entire length of the coil with a thermometer installed in a section from the cooling apparatus to a coiling machine after the cooling may be used. This is because the average value of the surface temperatures of the steel sheet throughout the entire length of the coil is equivalent to the coil temperature after the hot-rolled steel sheet is coiled into a coil shape. However, in order to reduce a material variation in the coil, the coiling temperature at an arbitrary point of the coil is preferably set to a maximum of 450° C. or lower. That is, the surface temperature of the steel sheet is preferably set to 450° C. or lower throughout the entire length of the coil.

The hot-rolled steel sheet manufactured by the above-described method may be left to be cooled to room temperature or may be cooled with water after coiled into a coil shape. In the case of having been cooled to room temperature, the hot-rolled steel sheet may be uncoiled again and pickled or may be subjected to skin pass rolling for adjusting residual stress or the shape. The rolling reduction of the skin pass rolling needs to be set to 0.5% or less.

Heat Treatment Step

On the hot-rolled steel sheet manufactured by the above-described steps, a heat treatment may be performed by holding the hot-rolled steel sheet in a temperature range of 200° C. or higher and lower than 450° C. for 90 to 80000 seconds in order to further improve the hole expansibility. When the heat treatment temperature is lower than 200° C., a change in the material quality is rarely recognized, and the manufacturing cost increases due to an increase in the number of the steps, which is not preferable. In addition, when the heat treatment temperature is 450° C. or higher, there are cases where the volume percentages of cementite and residual austenite in the hot-rolled steel sheet increase regardless of the holding time and the hole expansibility of the hot-rolled steel sheet deteriorates. The average temperature increase velocity in the heat treatment step is not particularly limited, but is preferably 0.01° C./sec or faster in order to prevent a decrease in the heat treatment efficiency. In addition, the atmosphere during the heat treatment may be an oxidizing atmosphere or an atmosphere substituted with N or the like. The heat treatment may be performed on the coil-shaped hot-rolled steel sheet; however, in this case, the holding time is preferably set to 120 seconds or longer in order to reduce a variation in the coil. When the holding time is longer than 80000 seconds, the material quality rarely changes, and the economic efficiency from the heat treatment is impaired, and thus the holding time may be set to 80000 seconds or shorter. A heat treatment method is not particularly limited; however, when the heat treatment time is 2000 seconds or shorter, the heat treatment is preferably performed after the coil is uncoiled from the viewpoint of the soaking property. The heat-treated hot-rolled steel sheet may be cooled to room temperature and then pickled in order to remove a scale formed by the hot rolling or a heat treatment if necessary.

EXAMPLES

Next, examples of the present invention will be described. Conditions in the examples are examples of the conditions adopted to confirm the feasibility and effect of the present invention. The present invention is not limited to these examples of the conditions. The present invention is capable of adopting a variety of conditions within the scope of the gist of the present invention as long as the object of the present invention is achieved.

Slabs having a chemical composition shown in Table 1 were manufactured by continuous casting. The casting velocity was 0.9 m/min. In addition, a mold was cooled to change the average surface temperature gradient in a region from the meniscus to 1.0 m from the meniscus, and hot-rolled steel sheets were obtained. The maximum time between stands in Table 2 and Table 3 is the maximum value of the elapsed times between individual rolling stands in a temperature range of 870° C. to 980° C. during finish rolling. In all examples, the elapsed time between the individual rolling stands in the temperature range of 870° C. to 980° C. was 0.3 seconds or longer. "ROT cooling time" in Tables 2 and 3 indicates a time taken from the completion of the finish rolling to the start of coiling. In addition, after the finish rolling, the slabs were cooled to "coiling temperatures after ROT cooling" in Table 2 and Table 3 and then coiled.

In Test No. 24 in Table 2 and Test No. 37 in Table 3, since cracks were recognized, it was not possible to perform the test after casting. In addition, in Test No. 30 in Table 3, since nozzle clogging during continuous casting was significant, and there was a concern of the incorporation of an oxide deposit or the like, the test after casting was not performed. In Test Nos. 14 to 18 and Nos. 20 to 23 in Table 2 and Test Nos. 38 and 48 in Table 3, a heat treatment was performed after hot rolling.

A test piece was collected from the obtained hot-rolled steel sheet, and the metallographic structure was measured by the above-described method. In addition, the tensile strength and the hole expansion rate were measured by the following methods from the same steel sheet. In addition, inside bend recessed parts were evaluated by the following method.

Measuring Method of Tensile Strength and Pass/Fail Determination Criterion

The tensile strength was obtained by performing a tensile test in accordance with JIS Z 2241: 2011 using a No. 5 test piece of JIS Z 2241: 2011. A position where the tensile test piece was collected was the central position in the sheet width direction, and a direction perpendicular to a rolling direction was the longitudinal direction.

In a case where the tensile strength was 880 MPa or more, the hot-rolled steel sheet was determined as pass for having a high strength, and, in a case where the tensile strength was less than 880 MPa, the hot-rolled steel sheet was determined as fail for not having a high strength.

Measuring Method of Hole Expansion Rate and Pass/Fail Determination Criterion

The hole expansion rate was obtained by performing a hole expansion test in accordance with JIS Z 2256: 2010.

In a case where the hole expansion rate was 35% or more, the hot-rolled steel sheet was determined as pass for having excellent formability, and, in a case where the hole expansion rate was less than 35%, the hot-rolled steel sheet was determined as fail for having poor formability.

Evaluating Method of Inside Bend Recessed Part After Forming and Pass/Fail Determination Criterion Suppression of the deterioration of high strength steel sheets due to inside bend recessed parts at the time of being applied to suspension components can be evaluated by the following method. An inside bend recessed part in a steel sheet is generated at a portion that does not come into contact with a die on the inside of a bend during bending forming. Even in the case of attempting to form a standing wall portion in a press-formed component with a complicated component shape, a non-contact section is generated. Reproduction of such a non-contact state in the inside of a bend may be the load of a V block method regulated in, for example, JIS Z 2248: 2014 or the like; however, regarding a punch, an opening part may be provided such that a non-contact section can be provided in the V center portion.

In a case where the shape of a pressed component is complicated, the recessed part is not a characteristic in a specific direction on the sheet surface, and it becomes necessary to suppress an inside bend recessed part in an arbitrary direction. Therefore, V-bending tests were performed in, with respect to a sheet travelling direction L of a steel sheet coil, the L direction, a C direction orthogonal to the L direction, and additionally, 5 directions at 15° intervals between the L and C directions. Bending tests were performed in these directions (a total of 7 directions), and the maximum recessed part depth in the inside bend was used as an index for evaluation. For pressed components with a complicated shape such as suspension components, the radius of the bent portion (bend radius) differs depending on design; however, when actual application is assumed, R/t, which is the ratio of the bend radius R to the sheet thickness t, of 1.5 may be regarded as the minimum bend radius. With bend radii larger than this, the bending distortion gradient in the sheet thickness direction becomes small, which does not become an evaluation on the safety side. Therefore, in the present examples, pass or fail was determined based on the maximum recessed part depth obtained by performing the bending tests with a bend radius for which R/t was set to 1.5. When the depth of the inside bend recessed part is less than 30.0 μm, no deterioration of component fatigue properties is recognized. Therefore, in a case where the obtained depth of the inside bend recessed part was less than 30.0 μm, the hot-rolled steel sheet was determined as pass since the depth of the inside bend recessed part that was formed during bending forming could be reduced. On the other hand, in a case where the obtained depth of the inside bend recessed part was 30.0 μm or more, the hot-rolled steel sheet was determined as fail since the depth of the inside bend recessed part that was formed during bending forming could not be reduced.

In the evaluation of the inside bend recessed part of a component, the minimum detectable depth by a dye penetrant testing method, which is ordinarily adopted, is 30.0 μm. The depth of the inside bend recessed part was measured by cutting a place in a bending test piece that did not come into contact with a punch along a cross section orthogonal to the bending axis, performing polishing such that burrs from the cutting could be removed, and observing the cross section. As the depth of a crack (the depth of the inside bend recessed part), a value obtained by measuring the distance in the depth direction from a tangent line of the inside bend toward the sheet thickness center in this cross section. The presence or absence of a recessed part can be determined by the dye penetrant testing method, which is ordinarily adopted, as a non-destructive method; however, usually, the accuracy is approximately 30.0 μm, which is not suitable.

The above-described measurement results are shown in Tables 4 and 5. In addition, the results obtained in the examples are shown in FIG. 1 to FIG. 3. FIG. 1 is a view showing the relationship between a sheet thickness direction position standardized by the sheet thickness of a region where the rotation angle between the normal line of the surface of the steel sheet and a (011) pole near the normal line becomes 5° or less and the depth of an inside bend recessed part. FIG. 2 is a view showing the relationship between a sheet thickness direction position standardized by the sheet thickness of a region where the rotation angle between the normal line of the surface of the steel sheet and a (011) pole near the normal line becomes 20° or more and the depth of an inside bend recessed part. FIG. 3 is a view showing the relationship among the sheet thickness direction position standardized by the sheet thickness of the region where the rotation angle between the normal line of the surface of the steel sheet and the (011) pole near the normal line becomes 5° or less, the sheet thickness direction position standardized by the sheet thickness of the region where the rotation angle between the normal line of the surface of the steel sheet and the (011) pole near the normal line becomes 20° or more, and the evaluation result of the inside bend recessed part.

TABLE 1

| | Chemical composition (mass %), remainder is Fe and impurity | | | | | | | | | | | | | |
|---|---|---|---|---|---|---|---|---|---|---|---|---|---|---|
| Steel | C | Si | Mn | Al | Nb | P | S | N | Ti | Mo | V | Cr | B | Note |
| A | 0.050 | 0.350 | 1.29 | 0.310 | 0.015 | 0.0090 | 0.0030 | 0.0028 | | | | | | Comparative steel |
| B | 0.130 | 0.720 | 2.40 | 0.050 | 0.018 | 0.0080 | 0.0040 | 0.0032 | | | | | | Present Invention Steel |
| C | 0.190 | 1.210 | 2.60 | 0.030 | 0.008 | 0.0100 | 0.0020 | 0.0033 | | | | | | Comparative steel |
| D | 0.080 | 0.070 | 1.81 | 0.512 | 0.006 | 0.0090 | 0.0030 | 0.0030 | | | | | | Present Invention Steel |
| E | 0.075 | 0.560 | 2.10 | 0.030 | 0.008 | 0.0070 | 0.0020 | 0.0038 | | | | | | Present Invention Steel |
| F | 0.143 | 1.290 | 2.60 | 0.270 | 0.022 | 0.0080 | 0.0035 | 0.0035 | | | | | | Present Invention Steel |
| G | 0.125 | 1.850 | 2.45 | 0.020 | 0.015 | 0.0090 | 0.0032 | 0.0028 | | | | | | Comparative steel |

TABLE 1-continued

| Steel | C | Si | Mn | Al | Nb | P | S | N | Ti | Mo | V | Cr | B | Note |
|---|---|---|---|---|---|---|---|---|---|---|---|---|---|---|
| | Chemical composition (mass %), remainder is Fe and impurity | | | | | | | | | | | | | |
| H | 0.120 | 1.110 | 1.13 | 0.030 | 0.016 | 0.0060 | 0.0021 | 0.0022 | | | | | | Comparative steel |
| I | 0.165 | 1.010 | 2.40 | 0.022 | 0.008 | 0.0070 | 0.0018 | 0.0031 | | | | | | Present Invention Steel |
| J | 0.082 | 0.620 | 3.07 | 0.018 | 0.007 | 0.0060 | 0.0036 | 0.0028 | | | | | | Comparative steel |
| K | 0.168 | 1.680 | 2.85 | 0.020 | 0.006 | 0.0100 | 0.0030 | 0.0025 | | | | | | Present Invention Steel |
| L | 0.063 | 0.050 | 2.72 | 0.030 | 0.037 | 0.0080 | 0.0026 | 0.0031 | | | | | | Present Invention Steel |
| M | 0.082 | 0.070 | 1.86 | 0.715 | 0.011 | 0.0090 | 0.0026 | 0.0029 | | | | | | Comparative steel |
| N | 0.062 | 0.060 | 1.31 | 0.020 | 0.021 | 0.0090 | 0.0026 | 0.0029 | | | | | | Present Invention Steel |
| O | 0.067 | 0.048 | 2.69 | 0.029 | 0.003 | 0.0080 | 0.0026 | 0.0030 | | | | | | Comparative steel |
| P | 0.110 | 0.930 | 2.54 | 0.021 | 0.036 | 0.0070 | 0.0019 | 0.0031 | | | | | | Present Invention Steel |
| Q | 0.122 | 0.720 | 2.30 | 0.032 | 0.072 | 0.0068 | 0.0022 | 0.0027 | | | | | | Comparative steel |
| R | 0.151 | 1.420 | 2.31 | 0.032 | 0.026 | 0.0080 | 0.0030 | 0.0070 | | | | | | Comparative steel |
| S | 0.130 | 0.710 | 2.18 | 0.032 | 0.020 | 0.0080 | 0.0020 | 0.0028 | 0.1350 | | | | 0.0014 | Present Invention Steel |
| T | 0.132 | 0.730 | 2.22 | 0.018 | 0.021 | 0.0060 | 0.0030 | 0.0034 | 0.1250 | | 0.1760 | 0.030 | | Present Invention Steel |
| U | 0.144 | 1.180 | 2.57 | 0.030 | 0.008 | 0.0080 | 0.0022 | 0.0032 | | 0.130 | | | | Present Invention Steel |
| V | 0.115 | 0.960 | 2.56 | 0.040 | 0.032 | 0.0080 | 0.0040 | 0.0025 | 0.0180 | 0.068 | | 0.030 | 0.0017 | Present Invention Steel |
| W | 0.093 | 0.440 | 1.48 | 0.173 | 0.018 | 0.0082 | 0.0042 | 0.0032 | 0.0130 | | 0.0630 | 0.082 | 0.0014 | Present Invention Steel |
| X | 0.060 | 0.032 | 1.31 | 0.020 | 0.030 | 0.0060 | 0.0020 | 0.0031 | 0.0450 | 0.081 | | 0.373 | | Present Invention Steel |
| Y | 0.132 | 0.730 | 2.12 | 0.052 | 0.013 | 0.0770 | 0.0013 | 0.0033 | | | | | 0.0021 | Present Invention Steel |
| Z | 0.141 | 0.701 | 2.11 | 0.038 | 0.014 | 0.0090 | 0.0082 | 0.0021 | | | | | | Present Invention Steel |

Underlines indicate that the corresponding values are outside the scope of the present invention.

TABLE 2

| Test No. | Steel | Average surface temperature gradient in region from meniscus to 1.0 m from meniscus ° C./m | Slab heating temperature ° C. | Slab heating residence time min | Total rolling reduction in temperature range of 870° C. to 980° C. % | Total rolling reduction in temperature range of lower than 870° C. % | Maximum time between stands sec |
|---|---|---|---|---|---|---|---|
| 1 | A | 321 | 1225 | 121 | 83 | 0 | 2.9 |
| 2 | B | 262 | 1222 | 131 | 86 | 0 | 2.8 |
| 3 | B | 315 | 1234 | 74 | 88 | 6 | 2.7 |
| 4 | B | 638 | 1243 | 42 | 85 | 0 | 2.7 |
| 5 | B | 698 | 1229 | 167 | 85 | 0 | 2.7 |
| 6 | C | 552 | 1236 | 175 | 82 | 0 | 2.8 |
| 7 | D | 443 | 1236 | 148 | 95 | 0 | 2.7 |
| 8 | E | 296 | 1240 | 238 | 86 | 0 | 3.8 |

TABLE 2-continued

| | | | | | | | |
|---|---|---|---|---|---|---|---|
| 9 | E | 340 | 1238 | 233 | 72 | 0 | 4.2 |
| 10 | E | 312 | 1233 | 154 | 85 | 7 | 3.6 |
| 11 | E | 642 | 1217 | 88 | 85 | 0 | 3.5 |
| 12 | E | 662 | 1235 | 67 | 85 | 0 | 3.8 |
| 13 | E | 313 | 1222 | 77 | 85 | 13 | 4.5 |
| 14 | F | 325 | 1220 | 45 | 83 | 0 | 2.9 |
| 15 | F | 322 | 1220 | 84 | 85 | 0 | 2.5 |
| 16 | F | 641 | 1225 | 69 | 87 | 0 | 2.6 |
| 17 | F | 294 | 1219 | 76 | 86 | 0 | 2.2 |
| 18 | G | 419 | 1229 | 77 | 93 | 0 | 2.8 |
| 19 | H | 584 | 1227 | 173 | 89 | 0 | 2.4 |
| 20 | I | 552 | 1230 | 108 | 83 | 0 | 4.4 |
| 21 | I | 541 | 1238 | 111 | 82 | 0 | 3.8 |
| 22 | I | 532 | 1232 | 106 | 79 | 0 | 4.2 |
| 23 | I | 653 | 1222 | 82 | 85 | 0 | 3.9 |
| 24 | J | 529 | Not performed due to slab cracking | | | | |
| 25 | K | 492 | 1233 | 109 | 96 | 0 | 3.2 |

| Test No. | ROT cooling time sec | Coiling temperature after ROT cooling ° C. | Skin pass rolling reduction % | Heat treatment temperature ° C. | Heat treatment time sec | Note |
|---|---|---|---|---|---|---|
| 1 | 15.0 | 25 | 0.2 | No treatment | No treatment | Comparative Example |
| 2 | 14.3 | 34 | 0.2 | No treatment | No treatment | Comparative Example |
| 3 | 13.8 | 29 | 0.2 | No treatment | No treatment | Present Invention Example |
| 4 | 12.6 | 29 | 0.2 | No treatment | No treatment | Present Invention Example |
| 5 | 12.5 | 29 | 0.2 | No treatment | No treatment | Comparative Example |
| 6 | 13.7 | 225 | 0.2 | No treatment | No treatment | Comparative Example |
| 7 | 12.7 | 26 | 0.2 | No treatment | No treatment | Present Invention Example |
| 8 | 13.0 | 28 | 0.2 | No treatment | No treatment | Comparative Example |
| 9 | 13.7 | 27 | 0.2 | No treatment | No treatment | Comparative Example |
| 10 | 15.2 | 29 | 0.2 | No treatment | No treatment | Present Invention Example |
| 11 | 14.4 | 28 | 0.2 | No treatment | No treatment | Present Invention Example |
| 12 | 14.1 | 28 | 0.2 | No treatment | No treatment | Comparative Example |
| 13 | 14.4 | 28 | 0.2 | No treatment | No treatment | Comparative Example |
| 14 | 14.2 | 125 | 0.2 | 440 | 98 | Present Invention Example |
| 15 | 32.3 | 20 | 0.2 | 437 | 78480 | Comparative Example |
| 16 | 14.5 | 25 | 0.2 | 435 | 78480 | Present Invention Example |
| 17 | 14.3 | 21 | 0.2 | 433 | 103 | Comparative Example |
| 18 | 14.6 | 28 | 0.2 | 290 | 135 | Comparative Example |
| 19 | 14.4 | 25 | 0.2 | No treatment | No treatment | Comparative Example |
| 20 | 14.1 | 28 | 0 | 458 | 102 | Comparative Example |
| 21 | 14.4 | 189 | 0 | 215 | 78840 | Present Invention Example |
| 22 | 14.3 | 281 | 0 | 436 | 74160 | Comparative Example |
| 23 | 15.2 | 223 | 0 | 436 | 74160 | Comparative Example |

TABLE 2-continued

| | | | | | | | |
|---|---|---|---|---|---|---|---|
| | 24 | | Not performed due to slab cracking | | | | Comparative Example |
| | 25 | 20.2 | 287 | 0.2 | No treatment | No treatment | Present Invention Example |

Underlines indicate that the corresponding values are outside the scope of the present invention.

TABLE 3

| Test No. | Steel | Average surface temperature gradient in region from meniscus to 1.0 m from meniscus ° C./m | Slab heating temperature ° C. | Slab heating residence time min | Total rolling reduction in temperature range of 870° C. to 980° C. % | Total rolling reduction in temperature range of lower than 870° C. % | Maximum time between stands sec |
|---|---|---|---|---|---|---|---|
| 26 | K | 501 | 1216 | 221 | 88 | 0 | 3.3 |
| 27 | L | 473 | 1227 | 100 | 89 | 0 | 3.3 |
| 28 | L | 483 | 1229 | 167 | 82 | 0 | 5.2 |
| 29 | L | 321 | 1232 | 126 | 77 | 0 | 4.9 |
| 30 | M | Not performed due to nozzle clogging in continuous casting step | | | | | |
| 31 | N | 444 | 1189 | 46 | 91 | 0 | 1.9 |
| 32 | N | 454 | 1240 | 29 | 85 | 0 | 2.9 |
| 33 | N | 455 | 1230 | 39 | 84 | 0 | 2.0 |
| 34 | N | 452 | 1223 | 38 | 86 | 0 | 1.9 |
| 35 | O | 521 | 1230 | 154 | 90 | 0 | 4.9 |
| 36 | P | 456 | 1241 | 139 | 81 | 0 | 4.2 |
| 37 | O | 482 | Not performed due to slab cracking | | | | |
| 38 | R | 491 | 1320 | 153 | 94 | 0 | 3.2 |
| 39 | S | 309 | 1272 | 143 | 92 | 0 | 3.0 |
| 40 | T | 310 | 1269 | 232 | 91 | 0 | 3.3 |
| 41 | T | 298 | 1224 | 273 | 92 | 0 | 3.3 |
| 42 | U | 611 | 1223 | 218 | 82 | 0 | 4.1 |
| 43 | V | 421 | 1223 | 221 | 81 | 0 | 3.5 |
| 44 | W | 503 | 1242 | 228 | 83 | 0 | 3.6 |
| 45 | X | 592 | 1256 | 269 | 85 | 0 | 4.4 |
| 46 | Y | 467 | 1251 | 245 | 93 | 0 | 3.8 |
| 47 | Z | 489 | 1255 | 249 | 91 | 0 | 3.9 |
| 48 | F | 320 | 1231 | 65 | 87 | 0 | 2.4 |

| Test No. | ROT cooling time sec | Coiling temperature after ROT cooling ° C. | Skin pass rolling reduction % | Heat treatment temperature ° C. | Heat treatment time sec | Note |
|---|---|---|---|---|---|---|
| 26 | 20.5 | 343 | 0.2 | No treatment | No treatment | Comparative Example |
| 27 | 15.5 | 282 | 0 | No treatment | No treatment | Present Invention Example |
| 28 | 15.2 | 281 | 0 | No treatment | No treatment | Comparative Example |
| 29 | 15.3 | 266 | 0 | No treatment | No treatment | Comparative Example |
| 30 | Not performed due to nozzle clogging in continuous casting step | | | | | Comparative Example |
| 31 | 12.6 | 252 | 0.2 | No treatment | No treatment | Comparative Example |
| 32 | 13.1 | 191 | 0.2 | No treatment | No treatment | Comparative Example |
| 33 | 13.3 | 325 | 0.2 | No treatment | No treatment | Comparative Example |
| 34 | 12.9 | 292 | 0.2 | No treatment | No treatment | Present Invention Example |
| 35 | 13.1 | 122 | 0.2 | No treatment | No treatment | Comparative Example |
| 36 | 12.9 | 25 | 0.2 | No treatment | No treatment | Present Invention Example |
| 37 | Not performed due to slab cracking | | | | | Comparative Example |

TABLE 3-continued

| | | | | | | |
|---|---|---|---|---|---|---|
| 38 | 14.8 | 25 | 0.2 | 440 | 103 | Comparative Example |
| 39 | 14.9 | 275 | 0 | No treatment | No treatment | Present Invention Example |
| 40 | 15.0 | 189 | 0 | No treatment | No treatment | Present Invention Example |
| 41 | 15.2 | 167 | 0 | No treatment | No treatment | Comparative Example |
| 42 | 14.2 | 25 | 0.2 | No treatment | No treatment | Present Invention Example |
| 43 | 14.9 | 28 | 0.2 | No treatment | No treatment | Present Invention Example |
| 44 | 14.1 | 181 | 0.2 | No treatment | No treatment | Present Invention Example |
| 45 | 14.7 | 286 | 0 | No treatment | No treatment | Present Invention Example |
| 46 | 14.3 | 171 | 0 | No treatment | No treatment | Present Invention Example |
| 47 | 15.1 | 276 | 0 | No treatment | No treatment | Present Invention Example |
| 48 | 28.7 | 20 | 0 | 441 | 78480 | Present Invention Example |

Underlines indicate that the corresponding values are outside the scope of the present invention.

TABLE 4

| Test No. | Sheet thickness direction position from surface standardized by sheet thickness of region where rotation angle between normal line of steel sheet surface and (011) pole near normal line becomes 5° or less | Sheet thickness direction position from surface standardized by sheet thickness of region where rotation angle between normal line of steel sheet surface and (011) pole near normal line becomes 20° or more | Average grain diameter of prior austenite grains 1 gm | Bainite + martensite volume % | Ferrite volume % | Cementite + residual austenite volume % | Tensile strength MPa | Hole expansion rate % | Depth of inside bend recessed part μm | Note |
|---|---|---|---|---|---|---|---|---|---|---|
| 1 | 0.137 | 0.263 | 19.81 | 72.3 | 27.4 | 0.3 | 855 | 73 | 25.4 | Comparative Example |
| 2 | 0.172 | 0.265 | 15.49 | 82.3 | 16.6 | 1.1 | 1160 | 45 | 33.4 | Comparative Example |
| 3 | 0.144 | 0.273 | 14.82 | 86.1 | 13.0 | 0.9 | 1182 | 46 | 27.4 | Present Invention Example |
| 4 | 0.122 | 0.254 | 16.11 | 87.5 | 11.3 | 1.2 | 1196 | 51 | 21.2 | Present Invention Example |
| 5 | 0.128 | 0.233 | 18.20 | 88.3 | 10.4 | 1.3 | 1208 | 52 | 35.1 | Comparative Example |
| 6 | 0.131 | 0.262 | 23.77 | 83.5 | 5.0 | 11.5 | 1306 | 32 | 27.3 | Comparative Example |
| 7 | 0.128 | 0.273 | 20.20 | 80.2 | 17.2 | 2.6 | 1084 | 62 | 24.4 | Present Invention Example |
| 8 | 0.152 | 0.268 | 23.13 | 84.3 | 15.4 | 0.3 | 994 | 73 | 30.4 | Comparative Example |
| 9 | 0.139 | 0.271 | 34.30 | 83.0 | 16.8 | 0.2 | 953 | 71 | 40.3 | Comparative Example |
| 10 | 0.143 | 0.268 | 23.40 | 83.1 | 16.6 | 0.3 | 972 | 64 | 27.3 | Present Invention Example |
| 11 | 0.132 | 0.254 | 21.60 | 84.3 | 15.4 | 0.3 | 1020 | 68 | 23.1 | Present Invention Example |

TABLE 4-continued

| Test No. | Sheet thickness direction position from surface standardized by sheet thickness of region where rotation angle between normal line of steel sheet surface and (011) pole near normal line becomes 5° or less | Sheet thickness direction position from surface standardized by sheet thickness of region where rotation angle between normal line of steel sheet surface and (011) pole near normal line becomes 20° or more | Average grain diameter of prior austenite grains 1 gm | Bainite + martensite volume % | Ferrite volume % | Cementite + residual austenite volume % | Tensile strength MPa | Hole expansion rate % | Depth of inside bend recessed part μm | Note |
|---|---|---|---|---|---|---|---|---|---|---|
| 12 | 0.128 | 0.247 | 24.30 | 82.2 | 17.3 | 0.5 | 983 | 70 | 31.5 | Comparative Example |
| 13 | 0.156 | 0.262 | 26.40 | 80.5 | 19.1 | 0.4 | 910 | 88 | 30.9 | Comparative Example |
| 14 | 0.141 | 0.271 | 10.35 | 81.5 | 13.7 | 4.8 | 935 | 46 | 18.3 | Present Invention Example |
| 15 | 0.143 | 0.265 | 12.33 | 78.3 | 16.1 | 5.6 | 854 | 51 | 26.5 | Comparative Example |
| 16 | 0.118 | 0.253 | 9.88 | 81.3 | 15.5 | 3.2 | 982 | 45 | 21.6 | Present Invention Example |
| 17 | 0.155 | 0.259 | 11.47 | 80.6 | 13.1 | 6.3 | 975 | 51 | 30.8 | Comparative Example |
| 18 | 0.129 | 0.272 | 9.76 | 83.5 | 5.4 | 11.1 | 1212 | 21 | 18.2 | Comparative Example |
| 19 | 0.113 | 0.262 | 8.84 | 70.6 | 27.3 | 2.1 | 863 | 48 | 13.6 | Comparative Example |
| 20 | 0.119 | 0.267 | 26.30 | 83.3 | 6.4 | 10.3 | 1254 | 28 | 26.1 | Comparative Example |
| 21 | 0.121 | 0.259 | 23.16 | 86.5 | 9.3 | 4.2 | 1435 | 38 | 23.3 | Present Invention Example |
| 22 | 0.126 | 0.263 | 30.90 | 88.1 | 4.3 | 7.6 | 1331 | 42 | 33.8 | Comparative Example |
| 23 | 0.123 | 0.248 | 24.68 | 87.1 | 5.6 | 7.3 | 1321 | 44 | 30.6 | Comparative Example |
| 24 | Not performed due to slab cracking | | | | | | | | | Comparative Example |
| 25 | 0.128 | 0.262 | 11.30 | 85.3 | 10.7 | 4.0 | 1013 | 38 | 12.6 | Present Invention Example |

Underlines indicate that the corresponding values are outside the scope of the present invention and the characteristic is not preferable.

TABLE 5

| Test No | Sheet thickness direction position from surface standardized by sheet thickness of region where rotation angle between normal line of steel sheet surface and (011) pole near normal line becomes 5° or less | Sheet thickness direction position from surface standardized by sheet thickness of region where rotation angle between normal line of steel sheet surface and (011) pole near normal line becomes 20° or more | Average grain diameter of prior austenite grains 1 gm | Bainite + martensite volume % | Ferrite volume % | Cementite + residual austenite volume % | Tensile strength MPa | Hole expansion rate % | Depth of inside bend recessed part μm | Note |
|---|---|---|---|---|---|---|---|---|---|---|
| 26 | 0.119 | 0.264 | 19.50 | 79.3 | 12.3 | 8.4 | 870 | 33 | 20.6 | Comparative Example |
| 27 | 0.128 | 0.266 | 6.38 | 81.2 | 16.2 | 2.6 | 932 | 63 | 8.31 | Present Invention Example |
| 28 | 0.118 | 0.268 | 32.30 | 80.7 | 17.0 | 2.3 | 907 | 66 | 34.4 | Comparative Example |
| 29 | 0.139 | 0.268 | 31.80 | 81.0 | 17.7 | 1.3 | 910 | 66 | 34.6 | Comparative Example |

TABLE 5-continued

| Test No | Sheet thickness direction position from surface standardized by sheet thickness of region where rotation angle between normal line of steel sheet surface and (011) pole near normal line becomes 5° or less | Sheet thickness direction position from surface standardized by sheet thickness of region where rotation angle between normal line of steel sheet surface and (011) pole near normal line becomes 20° or more | Average grain diameter of prior austenite grains 1 gm | Bainite + martensite volume % | Ferrite volume % | Cementite + residual austenite volume % | Tensile strength MPa | Hole expansion rate % | Depth of inside bend recessed part μm | Note |
|---|---|---|---|---|---|---|---|---|---|---|
| 30 | Not performed due to nozzle clogging in continuous casting step | | | | | | | | | Comparative Example |
| 31 | 0.121 | 0.273 | 14.32 | 78.6 | 19.6 | 1.8 | 875 | 43 | 18.3 | Comparative Example |
| 32 | 0.131 | 0.267 | 16.75 | 70.6 | 27.3 | 2.1 | 821 | 51 | 15.8 | Comparative Example |
| 33 | 0.127 | 0.263 | 17.08 | 74.6 | 24.1 | 1.3 | 867 | 55 | 22.1 | Comparative Example |
| 34 | 0.124 | 0.274 | 14.23 | 80.6 | 18.3 | 1.1 | 886 | 68 | 17.3 | Present Invention Example |
| 35 | 0.122 | 0.259 | 32.50 | 80.6 | 17.8 | 1.6 | 953 | 82 | 36.6 | Comparative Example |
| 36 | 0.120 | 0.268 | 25.60 | 86.3 | 11.5 | 2.2 | 1183 | 43 | 24.6 | Present Invention Example |
| 37 | Not performed due to slab cracking | | | | | | | | | Comparative Example |
| 38 | 0.123 | 0.266 | 8.30 | 88.2 | 1.5 | 10.3 | 1240 | 21 | 11.3 | Comparative Example |
| 39 | 0.145 | 0.252 | 5.38 | 82.3 | 14.6 | 3.1 | 1260 | 36 | 26.3 | Present Invention Example |
| 40 | 0.147 | 0.267 | 10.20 | 83.2 | 12.6 | 4.2 | 1220 | 42 | 17.3 | Present Invention Example |
| 41 | 0.157 | 0.275 | 8.33 | 82.2 | 13.7 | 4.1 | 1160 | 46 | 31.6 | Comparative Example |
| 42 | 0.109 | 0.256 | 25.60 | 88.9 | 8.0 | 3.1 | 1316 | 36 | 25.3 | Present Invention Example |
| 43 | 0.140 | 0.261 | 18.80 | 84.0 | 12.4 | 3.6 | 1203 | 43 | 28.6 | Present Invention Example |
| 44 | 0.117 | 0.275 | 22.60 | 82.9 | 14.8 | 2.3 | 1140 | 55 | 24.5 | Present Invention Example |
| 45 | 0.126 | 0.265 | 25.10 | 80.3 | 18.7 | 1.0 | 997 | 46 | 26.2 | Present Invention Example |
| 46 | 0.123 | 0.255 | 18.90 | 85.3 | 11.6 | 3.1 | 1183 | 45 | 17.1 | Present Invention Example |
| 47 | 0.121 | 0.262 | 17.67 | 83.2 | 14.3 | 2.5 | 1163 | 41 | 16.8 | Present Invention Example |
| 48 | 0.139 | 0.268 | 12.20 | 80.8 | 13.3 | 5.9 | 912 | 63 | 10.9 | Present Invention Example |

Underlines indicate that the corresponding values are outside the scope of the present invention and the characteristic is not preferable.

In Test Nos. 2, 8, 13, 17, and 41 where the region where the rotation angle between the normal line of the surface of the hot-rolled steel sheet and the (011) pole near the normal line becomes 5° or less was not present at 0.150 or less from the surface in terms of the sheet thickness direction position standardized by the sheet thickness, the depth of inside bend recessed part became 30.0 μm or more. In addition, in Test Nos. 5, 12, and 23 where the region where the rotation angle between the normal line of the surface of the hot-rolled steel sheet and the (011) pole near the normal line becomes 20° or more was not present at 0.250 or more from the surface in terms of the sheet thickness direction position standardized by the sheet thickness, the depth of inside bend recessed part became 30.0 μm or more.

In Test Nos. 9, 22, 29, and 35 where the average grain diameter of prior austenite grains was 30.00 μm or more, regardless of the fact that the hot-rolled steel sheet has the characteristic of the crystal orientation, the depth of the inside bend recessed part became 30.0 μm or more. That is, it is found that the control of the average grain diameter of prior austenite grains serves as a prerequisite for obtaining the effect of the control of crystal orientations in the sheet thickness direction in order to obtain a depth of the inside bend recessed part of less than 30.0 μm.

Therefore, the characteristic of the crystal orientation can be marshaled by the average surface temperature gradient in the region from the meniscus to 1.0 m from the meniscus.

In Test Nos. 2, 8, 17, and 41, the average surface temperature gradients in the region from the meniscus to 1.0 m from the meniscus were all less than 300° C./m. On the other hand, in Test Nos. 5, 12, and 23, the average surface temperature gradients in the region from the meniscus to 1.0 m from the meniscus were more than 650° C./m.

It is found that, in Test No. 13 where the average surface temperature gradient in the region from the meniscus to 1.0 m from the meniscus was 313° C./m and the total rolling reduction in the temperature range of lower than 870° C. during finish rolling exceeded 10%, the sheet thickness direction position standardized by the sheet thickness of the region where the rotation angle between the normal line of the surface of the steel sheet and the (011) pole near the normal line became 5° or less became 0.156 and it was not possible to reduce the depths of inside bend recessed parts.

In Test Nos. 3 and 10 where the average surface temperature gradients in the region from the meniscus to 1.0 m from the meniscus were close to 313° C./m and the total rolling reductions in the temperature range of lower than 870° C. during finish rolling were different, the sheet thickness direction position standardized by the sheet thickness of the region where the rotation angle between the normal line of the surface of the steel sheet and the (011) pole near the normal line became 5° or less became 0.150 or less. From these examples, it is determined that the total rolling reduction in the temperature range of lower than 870° C. during finish rolling being less than 10% is an appropriate condition.

It is found that the metallographic structure fractions of the hot-rolled steel sheet depend on the cooling conditions after rolling and the coiling conditions and excellent tensile strength and hole expansibility can be obtained by an appropriate chemical composition together with the above-described conditions.

From what has been described above, it was found that, within the scope of the gist of the present invention, the tensile strength is 880 MPa or more, the hole expansibility is excellent, and an inside bend recessed part, which has been a problem in applying hot-rolled steel sheets to components, can be improved.

INDUSTRIAL APPLICABILITY

According to the aspects of the present invention, it is possible to provide a hot-rolled steel sheet having a high strength and excellent formability and enabling reduction in the depth of an inside bend recessed part that is formed during bending forming and a manufacturing method thereof.

The invention claimed is:

1. A hot-rolled steel sheet comprising, as a chemical composition, by mass %:

C: 0.060% to 0.170%;
Si: 0.030% to 1.700%;
Mn: 1.20% to 3.00%;
Al: 0.010% to 0.700%;
Nb: 0.005% to 0.050%;
P: 0.0800% or less;
S: 0.0100% or less;
N: 0.0050% or less;
Ti: 0% to 0.1800%;
Mo: 0% to 0.150%;
V: 0% to 0.3000%;
Cr: 0% to 0.500%;
B: 0% to 0.0030%; and
a remainder consisting of Fe and an impurity, wherein, in metallographic structures at a ¼ position in a sheet thickness direction from a surface and at a ½ position in the sheet thickness direction from the surface, by vol %, bainite and martensite are a total of 80.0% or more, ferrite is 20.0% or less, and cementite and residual austenite are a total of 0% to 10.0%, in a metallographic structure of a region from the surface to a 100 μm position in the sheet thickness direction from the surface, an average grain diameter of prior austenite grains is less than 30.00 μm, a region, where a rotation angle between a normal line of the surface and a (011) pole near the normal line is 5° or less, is 0.150 or less from the surface in terms of a sheet thickness direction position standardized by a sheet thickness, a region, where the rotation angle between the normal line of the surface and the (011) pole near the normal line becomes 20° or more, is 0.250 or more from the surface in terms of the sheet thickness direction position standardized by the sheet thickness, and a tensile strength is 880 MPa or more.

2. The hot-rolled steel sheet according to claim 1, comprising, as the chemical composition, by mass %, one or more selected from the group of:

Ti: 0.0200% to 0.1800%;
Mo: 0.030% to 0.150%;
V: 0.0500% to 0.3000%,
Cr: 0.050% to 0.500%; and
B: 0.0001% to 0.0030%.

3. A manufacturing method of the hot-rolled steel sheet according to claim 1, comprising:

a casting step of, in continuous casting of a slab having the chemical composition according to claim 1, performing the continuous casting in a manner that an average surface temperature gradient in a region from a meniscus to 1.0 m from the meniscus becomes 300 to 650° C./m to obtain the slab;

a heating step of heating the slab to 1200° C. or higher and holding the slab for 30 minutes or longer;

a hot rolling step of performing rough rolling on the slab, and performing finish rolling in a manner that a total rolling reduction in a temperature range of 870° C. to 980° C. becomes 80% or larger, an elapsed time between rolling stands in the temperature range of 870° C. to 980° C. becomes 0.3 to 5.0 seconds, and a total rolling reduction in a temperature range of lower than 870° C. becomes smaller than 10%;

a cooling step of cooling for 30.0 seconds or shorter to cool to a temperature range of lower than 300° C. after the finish rolling; and a coiling step of, coiling in a manner that a coiling temperature becomes lower than 300° C. after the cooling.

4. The manufacturing method of the hot-rolled steel sheet according to claim 3, further comprising:

a heat treatment step of holding in a temperature range of 200° C. or higher and lower than 450° C. for 90 to 80000 seconds after the coiling.

5. A manufacturing method of the hot-rolled steel sheet according to claim 2, comprising:

a casting step of, in continuous casting of a slab having the chemical composition, performing the continuous casting in a manner that an average surface temperature gradient in a region from a meniscus to 1.0 m from the meniscus becomes 300 to 650° C./m to obtain the slab;

a heating step of heating the slab to 1200° C. or higher and holding the slab for 30 minutes or longer;

a hot rolling step of performing rough rolling on the slab, and performing finish rolling in a manner that a total rolling reduction in a temperature range of 870° C. to 980° C. becomes 80% or larger, an elapsed time between rolling stands in the temperature range of 870° C. to 980° C. becomes 0.3 to 5.0 seconds, and a total rolling reduction in a temperature range of lower than 870° C. becomes smaller than 10%;

a cooling step of cooling for 30.0 seconds or shorter to cool to a temperature range of lower than 300° C. after the finish rolling; and a coiling step of, coiling in a manner that a coiling temperature becomes lower than 300° C. after the cooling.

6. A hot-rolled steel sheet comprising, as a chemical composition, by mass %:

C: 0.060% to 0.170%;
Si: 0.030% to 1.700%;
Mn: 1.20% to 3.00%;
Al: 0.010% to 0.700%;
Nb: 0.005% to 0.050%;
P: 0.0800% or less;
S: 0.0100% or less;
N: 0.0050% or less;
Ti: 0% to 0.1800%;
Mo: 0% to 0.150%;
V: 0% to 0.3000%;
Cr: 0% to 0.500%;
B: 0% to 0.0030%; and a remainder comprising Fe and an impurity, wherein, in metallographic structures at a ¼ position in a sheet thickness direction from a surface and at a ½ position in the sheet thickness direction from the surface, by vol %, bainite and martensite are a total of 80.0% or more, ferrite is 20.0% or less, and cementite and residual austenite are a total of 0% to 10.0%, in a metallographic structure of a region from the surface to a 100 μm position in the sheet thickness direction from the surface, an average grain diameter of prior austenite grains is less than 30.00 μm, a region, where a rotation angle between a normal line of the surface and a (011) pole near the normal line is 5° or less, is 0.150 or less from the surface in terms of a sheet thickness direction position standardized by a sheet thickness, a region, where the rotation angle between the normal line of the surface and the (011) pole near the normal line becomes 20° or more, is 0.250 or more from the surface in terms of the sheet thickness direction position standardized by the sheet thickness, and a tensile strength is 880 MPa or more.

* * * * *